US005368499A

United States Patent [19]

Hirt

[11] Patent Number: 5,368,499

[45] Date of Patent: Nov. 29, 1994

[54] MULTI-LEAD ELECTRIC PLUG CONNECTOR

[75] Inventor: Ingo Hirt, Hanover, Germany

[73] Assignee: Wabco Westinghouse Fahrzeugbremsen GmbH, Hanover, Germany

[21] Appl. No.: 676,893

[22] Filed: Mar. 28, 1991

[30] Foreign Application Priority Data

Apr. 4, 1990 [DE] Germany ..... 4010836

[51] Int. Cl.[5] ..... H01R 13/627

[52] U.S. Cl. ..... 439/350; 439/282; 439/281

[58] Field of Search ..... 439/271, 272, 281, 282, 439/283, 350, 351

[56] References Cited

U.S. PATENT DOCUMENTS

| | | | |
|---|---|---|---|
| 1,981,460 | 11/1934 | Miller | 439/281 |
| 3,166,371 | 1/1965 | Brown et al. | 439/281 |
| 3,199,060 | 8/1965 | Marasco | 439/282 |
| 3,601,761 | 8/1971 | Harris | 439/281 |
| 3,685,004 | 8/1972 | Kerr | 439/281 |
| 3,824,524 | 7/1974 | Glover | 439/282 |
| 4,772,231 | 9/1988 | Hayes | 439/283 |
| 4,940,420 | 7/1990 | Munie | 439/272 |

*Primary Examiner*—Larry I. Schwartz
*Assistant Examiner*—Hien D. Vu
*Attorney, Agent, or Firm*—Horst M. Kasper

[57] ABSTRACT

A multi-lead electrical plug connector is disclosed including a plug part (4) and a socket part (5). The plug connector is furnished in particular for the connection of two cables, each cable having two conducting wires. The plug connector is subdivided into two end section (A, C) with round cross-section and a center section (B) with an oval or flat cross-section, respectively. Two contact pins (1, 2) and two contact shells (14, 15) are furnished, which are disposed adjacent to each other on the longitudinal axis (3) of the oval section. The plug connector is furnished in particular for the heavy-duty operating conditions present, for example, in motor vehicles.

29 Claims, 3 Drawing Sheets

MULTI-LEAD ELECTRIC PLUG CONNECTOR

BACKGROUND OF THE INVENTION

1. Field of the Invention

The invention refers to a multi-lead electric plug connector, where cables having at least two conductors are connected with a plug and a socket and include a locking and bolting device formed as snap connection.

2. Brief Description of the Background of the Invention Including Prior Art

Electrical plug connectors of the kind above recited are employed predominantly in motor vehicles, and in particular, in commercial vehicles. These plug connectors have to be stable against, and sustain increased wear and load during operation, such as heat, cold, vibrations, dirt, rock-fall, stoning, humidity, and splash water. The electric plug connectors therefore have to be constructed sturdily and reliably. This is particularly necessary where the cables to be connected perform functions which are important for the safe operation of a vehicle such as, for example, an anti-skid system or an electrical braking system.

A further aspect is to provide an easy mounting, demounting, and connecting of the plug connector, and in fact, even under unfavorable conditions such as low visibility based on a hidden mounting or insufficient illumination.

Furthermore, the production and the mounting expenses of the electric plug connector should be as low as possible, in view of its use as a motor vehicle assembly line component.

Finally, the clamping force and the locking and connecting ability of the electric plug connector have to be sufficiently high in the plugged-in state in order to prevent an autonomous disengagement. For this purpose, snap-in connections are known from the European Patent EP 0,187,887, which retain the plug part and the socket part together with a defined force. However, the known electric plug device, is not constructed sufficiently stable and sturdy for use in a motor vehicle.

The German Printed Patent Document DE 2,942,569 to Robert Gilbert Plyler features an electrical connection device. The overall device structure illustrated in FIG. 6 of the reference is oval. However, the structure disclosed in this reference is not suitable for providing a stable connection to a cable containing several conductors, since instead individual conductors are taught to be employed according this reference.

The German Printed Patent Publication DE 2,837,275 to Clair Wilson Snyder Jr et al, teaches a connector component with sealing members and their production. The plug and sockets of in FIG. 1 of the reference show essentially a circular circumference. In addition, these reference plugs and reference sockets are constructed for multiple, separate wires emanating from the plug or socket, respectively. Such structures with multiple wires converging to a plug would not be suitable for the operating conditions of commercial vehicles.

The U.S. Pat. No. 4,611,872 to Katsuya Ito et al. teaches a waterproof connector. FIG. 9C of this reference illustrates a side sectional view of a male connector housing, including oval outer surface areas. The rear end portion 24 of the male connector housing 20 is recessed at 23. Such recessed structure results in a limited possibility of holding the cable, and of gripping the plug connector for a firm and sturdy connection.

SUMMARY OF THE INVENTION

1. Purposes of the Invention

It is an object of the present invention to provide a plug connector for multiple electrical conductors, which meets heavy-duty operating conditions and which allows subjection to commercial transport conditions, and which is additionally built as small as possible under consideration of preset current and voltage load values.

It is another object of the present invention to provide an electric plug connector having a particularly small diameter in the area of the connection, in order to be able to employ and use the connector in cases of narrow deposit spaces.

It is yet a further object of the present invention to provide a plug connector which is solidly connected to the respective cables, while minimizing the weight and outer volume of the conductor.

These and other objects and advantages of the present invention will become evident from the description which follows.

2. Brief Description of the Invention

According to the present invention there is provided for an electrical plug connector. A plug end section having a first end and an oppositely disposed second end is attached at the first end to a first cable. A support body having a first end and a second end is attached with the first end to the second end of the plug end section and has a cross-section of elongated shape. At least two pins are mounted to the second end of the support body and are connected to wires of a first cable end. Contact shells are formed to engage with the pins. A casing part has a first end and a second end and forms a cup shape with the second end defining the bottom of the cup and supporting the contact shells. The casing part has a cross-section of elongated shape such that the support body with the pins can be inserted into the casing part with the pins being inserted into the socket for providing an electrical connection between pins and contact shells. A socket end section has a first end and a second end with the first end connected to the second end of the casing part and with the second end to be attached to a second cable end and with wires of the second cable end connected to the contact shells.

The plug end can substantially form a cylindrical outer surface. The socket end can substantially form a cylindrical outer surface.

The support body and the casing part can substantially form an oval outer section or an elongated rectangular outer section.

The electrical plug connector can comprise a snap-in connection between the support body and the casing part.

A cam can be disposed on the support body. A recess can be disposed on the casing part such that the cam can engage the recess interlockingly upon insertion of the support body into the casing part.

The cam can be disposed on an elongated side of the support body and the recess can be disposed on an elongated side of the casing part.

A groove can be disposed circumferentially in a plane perpendicular to a connection direction in the support body. An O-ring disposed in the groove can sealingly engage an opposed inner surface of the casing part.

A collar can be disposed at the first end of the support body. A recess ring, can be disposed inside of the casing part at the first end of the casing part for matching the collar upon insertion of the support body into the casing part.

A first outer annular ring recess can be disposed in the plug end for reliably handling the plug and a second outer annular ring recess can be disposed in the socket end for reliably handling the socket.

The plug can protrude such as to penetrate into the socket end upon a full insertion of the support body into the casing part.

The plug connector of the present invention meets the requirements for such connectors used in conjunction with commercial vehicles. The invention plug connector is provided with a widened center section having a flat and oval cross-sectional form, respectively. This elongated rectangular or oval cross-sectional shape is in contrast to conventional constructions, which exhibit either a substantially and throughout round or a substantially and throughout flat cross-section. The particular structure of the invention electric plug connector with an overall oval cross-section including round end sections, and an oval or flat center section allows to meet the required electrical and mechanical values while using minimized or prescribed dimensions, respectively.

The invention structure minimizes the volume at the connection point of the plug structure while furnishing maximum junction stability at the point of the connection to the cable.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 7 is an in part sectional view of the plug connector of FIG. 2 along section line 7—7;

FIG. 8 is an in part sectional view of the plug connector of FIG. 2 along section line 8—8.

DESCRIPTION OF INVENTION AND PREFERRED EMBODIMENT

Figures 1, 5, 6:
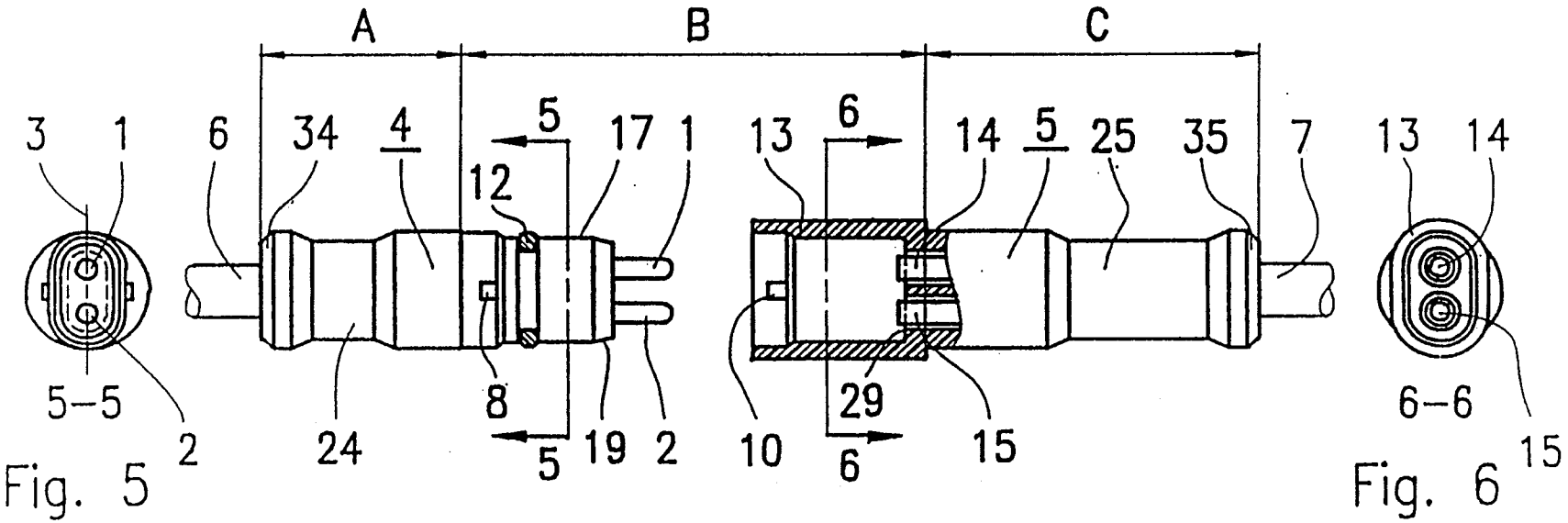
FIG. 1 is a side-elevational and in part sectional view of the plug connector of the present invention in a disjoint state.
FIG. 5 is an in part sectional view of the plug connector according to FIG. 1 along a section line 5—5.
FIG. 6 is an in part sectional view of the plug connector of FIG. 1 along section line 6—6.

According to the present invention there is provided for an electrical plug connector in particular for the connection of two two-wire cables 6, 7 with a plug 4 and a socket 5, as well as with an interlocking device, which is furnished as a snap-in connection. The plug connector is subdivided into two end sections A, C with circular cross-sections, and a middle section B with an oval or a flat cross-section. At least two contact pins 1, 2 as well as two contact shells 14, 15 are furnished, which are disposed preferably on the longitudinal axis 3 of the oval section B.

The snap connection can comprise at least one cam 8, 9. This cam 8, 9 can be disposed on the flat side of the oval or flat section B of the plug 4 and can engage in a corresponding recess 10, 11 of the socket 5.

A sealing device can be furnished formed by an elongatedly shaped O-ring 12. The O ring 12 can rest at the inner wall of the oval casing part 13 of the socket 5 in the plugged-in state of the plug connector.

The multi-lead electric plug connector of the present invention is illustrated in FIG. 1 in a side view, wherein part sections are illustrated. The electrical plug connector comprises a plug 4 and a socket 5, which plug 4 and socket 5 can be joined for allowing to connect the cables 6 and 7. The plug and socket components 4, 5 are substantially made of plastic. The plastic is to be a kind of plastic for sufficing the requirement with respect to heat and cold stability. The outer diameter of the plug connector can typically be from about 5 to 50 millimeters and is preferably from about 10 to 20 millimeters.

Two contact pins 1, 2 are disposed opposite to two contact shells 14, 15. The shells 14, 15 can exert a clamping force on the contact pins 1, 2 in the connected state. The pins 1, 2 are supported by an inner support body 17, which has an outer shape closely matching the inner shape of a casing part 13. Preferably, the support body 17 is furnished with a collar section 19, which in turn closely matches the inner shape of an end section 29 of the casing part 13.

The plug connector is furnished in the section A with a circular shape, and in the section B with a flat or an oval cross-section, respectively, and in the section C again with an about circular cross-section. The contact pins and the contact shells are disposed next to each other on the longitudinal axis 3 of the oval section B as illustrated in FIGS. 5 and 6.

Figure 2:
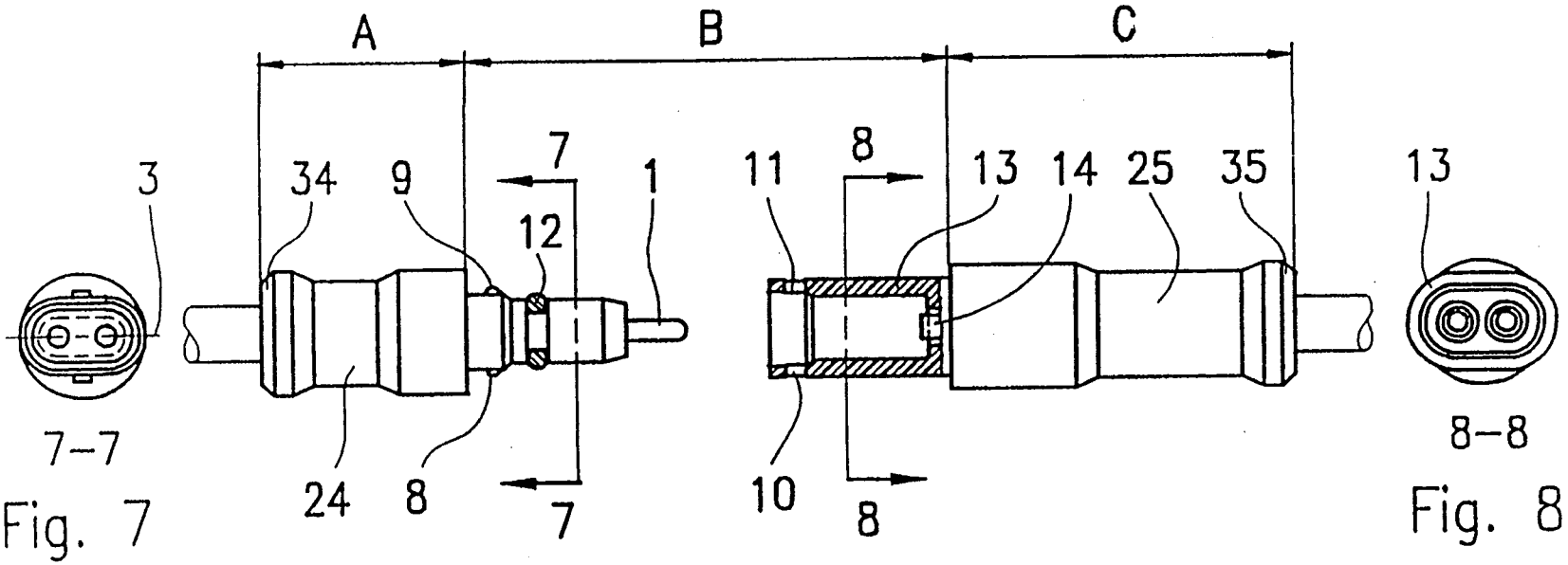
FIG. 2 is a view of the embodiment of FIG. 1 at a position rotated by 90 degrees relative to the position illustrated in FIG. 1.
Figure 3:
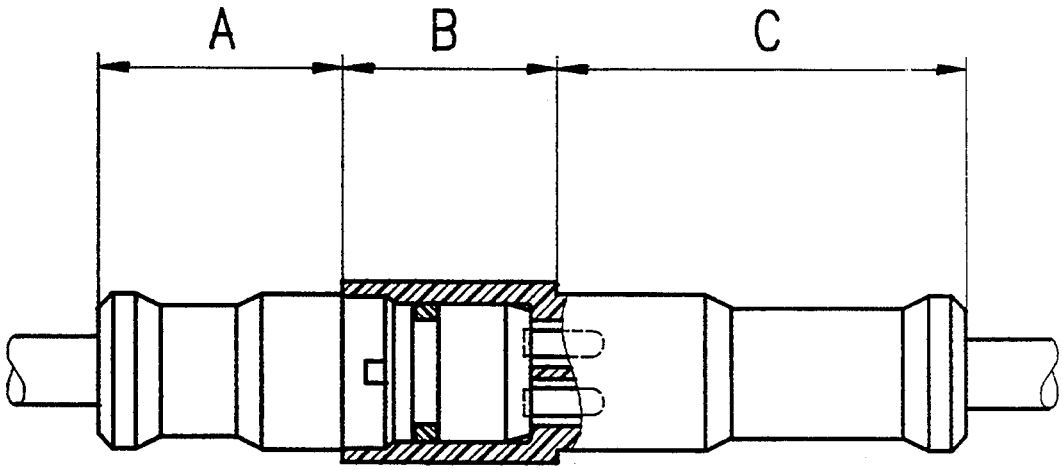
FIG. 3 is a side-elevational and in part sectional view of the plug connection in the plugged-in state.
Figure 4:
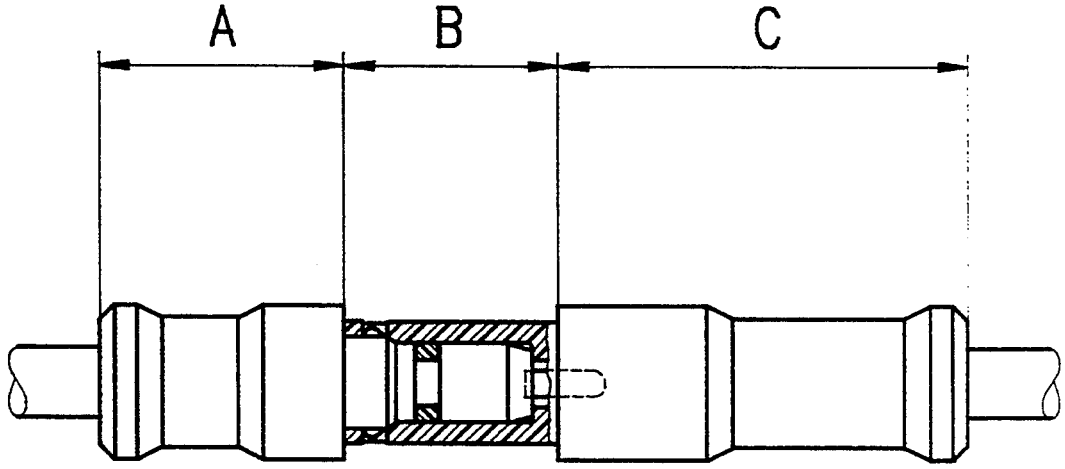
FIG. 4 is a view of the embodiment of FIG. 3 rotated by 90 degrees.

An interlocking mechanism with defined disconnection and separation force serves to keep the plug connector in a connected position of plug 4 and socket 5 in the plugged-together state of the plug connector, as illustrated in FIGS. 3 and 4. The interlocking mechanism comprises a snap connection with two cams 8, 9, which cams 8, 9 are disposed on the flat side of the oval section B of the plug 4. In the plugged-in state, the cams 8, 9 can be snapped into corresponding recesses 10, 11 of the socket 5. The recesses 10, 11 of the socket 5 are disposed on the broad side of the oval casing part 13 of the socket 5, as illustrated in FIG. 2. The interlocking mechanism is perferably formed such as to minimize penetration of outside elements such as dirt and water toward the position of pins and sockets.

The furnishing of the recesses 10, 11 on the wider side of the casing part 13 results in a particularly easy spring recoiling of the casing part 13 upon insertion. This feature would not be present in case of a circular structure. In addition, the separating force during release of the plug connector can be defined more precisely based on this structure.

The FIGS. 7 and 8 serve for illustrating the transition from the circular sections A, C to the in between flat section B FIG. 1 and 2.

In addition, a sealing device is furnished formed by an O-ring 12. The O-ring 12 is disposed such as to separate the pins 1, 2 and the contact shells 14, 15 from the interlocking mechanism formed by cams 8, 9 and recess 10, 11. Based on its elasticity, the O-ring 12 adapts itself to the oval or flat cross-section of the plug part of the connector. The O-ring 12 is inserted into a peripheral groove of the plug 4. The O-ring 12 rests at the inner wall of the oval casing part 13 of the socket 5 in the plugged-in state of the plug connector. The O-ring 12 thus seals the plug connector against the penetration of moisture and humidity into the area of the pin and socket connection.

The invention of plug connector is associated with a particular advantage versus an overall circular, cylindrical structure in that a person can blindly and without looking position the plug and the socket such as to engage each other while in proper relative position based on the sensed flat or oval structure of the center section B.

The embodiment illustrated does not show any asymmetry or polarity, which would require rotation of the plug or, respectively, an exchange of the contacts 1, 2. Thus exchange of pins 1 and 2 is of no consequence in the connecting or plugging together of the embodiment of FIGS. 1 and 2. However, additional known features, for example, a cam and a corresponding groove, would allow to obtain a coding of the plug connector and thus a polarized plug would be furnished, such that an erroneous pole and wire connection could be excluded.

The cross-section of the plug and the socket, respectively, in the connection region is desired to be substantially oval in its overall structure, i.e. sharp edges are avoided. Furthermore, the overall oval appearance can be obtained by various measures, for example, the structure can be of an elliptical outer cross-section. Preferably the electrical structure would be such that, in case of two wires, these wires are substantially disposed in the neighborhood of the focal points of the ellipse. Such structure will maximize the shielding and protection capabilities of the plug versus the prongs. Alternatively, a straight section could be employed with semi circles at the respective two ends of the cross-section. In particular, the length of the straight section would be from 1.0 to 2.5 times the distance of the two prongs.

The thickness ratio of the elongated wider section to the narrow section can be from about 1.5 to 10 and preferably is from about 2 to 5, and more preferably from about 2.5 to 3.

The sections A of the plug 4 and C of the socket 5 serve to support the cable connection and has handles for transforming manual force to make a connection. A narrower section 24, 25 can be provided to enhance the possibility of firmly gripping the plug 4 and socket 5 by hand. The cable 6, 7 is preferably sealingly connected to the end sections 34, 35 of the plug 4 or socket 5.

It will be understood that each of the elements described above, or two or more together, may also find a useful application in other types of plug connectors differing from the types described above.

While the invention has been illustrated and described as embodied in the context of a multi-lead electric plug connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrical plug connector comprising a plug end section having a first end, an oppositely disposed second end and substantially forming a cylindrical outer surface, said plug end section to be attached at the first end to a first cable;

a support body having a first end and having a second end, wherein the first end of the support body is attached to the second end of the plug end section, and wherein the support body has a cross-section of elongated shape;

at least two pins mounted to the second end of the support body, wherein said pins are connectable to wires of the first cable;

contact shells formed to engage with the pins;

a casing part having a first end and having a second end and forming a cup shape, with the second end defining the bottom of the cup and supporting the contact shells and having a cross-section of elongated shape such that the support body with the pins can be inserted into the casing part, wherein the two pins inserted into a socket for providing an electrical connection between the pins and the contact shells;

a socket end section having a first end and having a second end with the first end connected to the second end of the casing part and with the second end to be attached to a second cable and with wires of the second cable connected to the contact shells, wherein the support body and the casing part substantially form an oval outer section.

2. The electrical plug connector according to claim 1 wherein the socket end substantially forms a cylindrical outer surface.

3. The electrical plug connector according to claim 1 wherein the support body and the casing part substantially form an elongated rectangular outer section.

4. The electrical plug connector according to claim 1 further comprising a snap-in connection between the support body and the casing part.

5. The electrical plug connector according to claim 1 further comprising a cam disposed on the support body;

a recess disposed on the casing part such that the cam can engage the recess interlockingly upon insertion of the support body into the casing part.

6. The electrical plug connector according to claim 1 wherein the cam is disposed on an elongated side of the support body and wherein the recess is disposed on an elongated side of the casing part.

7. The electrical plug connector according to claim 1 further comprising a groove disposed circumferentially in a plane perpendicular to a connection direction in the support body;

an O-ring disposed in the groove for sealingly engaging an opposed inner surface of the casing part.

8. The electrical plug connector according to claim 1 further comprising a collar disposed at the first end of the support body;

a recess ring disposed inside of the casing part at the first end of the casing part for matching the collar disposed on the first end of the support body upon insertion of the support body into the casing part.

9. The electrical plug connector according to claim 1 further comprising a first outer annular ring recess disposed in the plug end for reliable handling of the plug;

a second outer annular ring recess disposed in the socket end for reliable handling of the socket.

10. The electrical plug connector according to claim 1 wherein the pins mounted to the second end of the support body protrude from the support body such as to penetrate into the socket end upon a full insertion of the support body into the casing part.

11. An electrical plug connector comprising a plug end section having a first end, an oppositely disposed second end and substantially forming a cylindrical outer surface, said plug end section to be attached at the first end to a first cable;

a support body having a first end and having a second end, wherein the first end of the support body is attached to the second end of the plug end section, and wherein the support body has a cross-section of elongated shape;

at least two pins mounted to the second end of the support body, wherein said pins are connectable to wires of the first cable;

contact shells formed to engage with the pins;

a casing part having a first end and having a second end and forming a cup shape, with the second end defining the bottom of the cup and supporting the contact shells and having a cross-section of elongated shape such that the support body with the pins can be inserted into the casing part, wherein the two pins are inserted into a socket for providing an electrical connection between the pins and the contact shells;

a socket end section having a first end and having a second end with the first end connected to the second end of the casing part and with the second end to be attached to a second cable and with wires of the second cable connected to the contact shells, wherein the socket end substantially forms a cylindrical outer surface, wherein the support body and the casing part substantially form an oval outer section, and further comprising a snap-in connection between the support body and the casing part.

12. An electrical plug connector comprising a plug end section having a first end, an oppositely disposed second end and substantially forming a cylindrical outer surface, said plug end section to be attached at the first end to a first cable;

a support body having a first end and having a second end, wherein the first end of the support body is attached to the second end of the plug end section, and wherein the support body has a cross-section of elongated shape;

at least two pins mounted to the second end of the support body, wherein said pins are connectable to wires of the first cable;

contact shells formed to engage with the pins;

a casing part having a first end and having a second end and forming a cup shape, with the second end defining the bottom of the cup and supporting the contact shells and having a cross-section of elongated shape such that the support body with the pins can be inserted into the casing part, wherein the two pins are inserted into a socket for providing an electrical connection between the pins and the contact shells;

a socket end section having a first end and having a second end with the first end connected to the second end of the casing part and with the second end to be attached to a second cable and with wires of the second cable connected to the contact shells, wherein the socket end substantially forms a cylindrical outer surface, wherein the support body and the casing part substantially form an elongated rectangular outer section, further comprising a snap-in connection between the support body and the casing part.

13. An electrical plug connector comprising a plug end section having a first end, an oppositely disposed second end and substantially forming a cylindrical outer surface, said plug end section to be attached at the first end to a first cable;

a support body having a first end and having a second end, wherein the first end of the support body is attached to the second end of the plug end section, and wherein the support body has a cross-section of elongated shape;

at least two pins mounted to the second end of the support body, wherein said pins are connectable to wires of the first cable;

contact shells formed to engage with the pins;

a casing part having a first end and having a second end and forming a cup shape, with the second end defining the bottom of the cup and supporting the contact shells and having a cross-section of elongated shape such that the support body with the pins can be inserted into the casing part, wherein the two pins inserted into a socket for providing an electrical connection between the pins and the contact shells;

a socket end section having a first end and having a second end with the first end connected to the second end of the casing part and with the second end to be attached to a second cable and with wires of the second cable connected to the contact shells, wherein the support body and the casing part substantially form an elongated rectangular outer section.

14. The electrical plug connector according to claim 13 wherein the socket end substantially forms a cylindrical outer surface.

15. The electrical plug connector according to claim 13 further comprising a snap-in connection between the support body and the casing part.

16. The electrical plug connector according to claim 13 further comprising a cam disposed on the support body;

a recess disposed on the casing part such that the cam can engage the recess interlockingly upon insertion of the support body into the casing part.

17. The electrical plug connector according to claim 13 wherein the cam is disposed on an elongated side of the support body and wherein the recess is disposed on an elongated side of the casing part.

18. The electrical plug connector according to claim 13 further comprising a groove disposed circumferentially in a plane perpendicular to a connection direction in the support body;

an O-ring disposed in the groove for sealingly engaging an opposed inner surface of the casing part.

19. The electrical plug connector according to claim 13 further comprising a collar disposed at the first end of the support body;

a recess ring disposed inside of the casing part at the first end of the casing part for matching the collar disposed on the first end of the support body upon insertion of the support body into the casing part.

20. The electrical plug connector according to claim 13 further comprising a first outer annular ring recess disposed in the plug end for reliable handling of the plug;

a second outer annular ring recess disposed in the socket end for reliable handling of the socket.

21. The electrical plug connector according to claim 13 wherein the pins mounted to the second end of the support body protrude from the support body such as to penetrate into the socket end upon a full insertion of the support body into the casing part.

22. An electrical plug connector comprising a plug end section having a first end, an oppositely disposed second end and substantially forming a cylindrical outer surface, said plug end section to be attached at the first end to a first cable;

a support body having a first end and having a second end, wherein the first end of the support body is attached to the second end of the plug end section, and wherein the support body has a cross-section of elongated shape;

at least two pins mounted to the second end of the support body, wherein said pins are connectable to wires of the first cable;

contact shells formed to engage with the pins;

a casing part having a first end and having a second end and forming a cup shape, with the second end defining the bottom of the cup and supporting the contact shells and having a cross-section of elongated shape such that the support body with the pins can be inserted into the casing part, wherein the two pins inserted into a socket for providing an electrical connection between the pins and the contact shells;

a socket end section having a first end and having a second end with the first end connected to the second end of the casing part and with the second end to be attached to a second cable and with wires of the second cable connected to the contact shells;

a collar disposed at the first end of the support body;

a recess ring disposed inside of the casing part at the first end of the casing part for matching the collar disposed on the first end of the support body upon insertion of the support body into the casing part.

23. The electrical plug connector according to claim 22 wherein the socket end substantially forms a cylindrical outer surface.

24. The electrical plug connector according to claim 22 further comprising a snap-in connection between the support body and the casing part.

25. The electrical plug connector according to claim 22 further comprising a cam disposed on the support body;

a recess disposed on the casing part such that the cam can engage the recess interlockingly upon insertion of the support body into the casing part.

26. The electrical plug connector according to claim 22 wherein the cam is disposed on an elongated side of the support body and wherein the recess is disposed on an elongated side of the casing part.

27. The electrical plug connector according to claim 22 further comprising a groove disposed circumferentially in a plane perpendicular to a connection direction in the support body;

an O-ring disposed in the groove for sealingly engaging an opposed inner surface of the casing part.

28. The electrical plug connector according to claim 22 further comprising a first outer annular ring recess disposed in the plug end for reliable handling of the plug;

a second outer annular ring recess disposed in the socket end for reliable handling of the socket.

29. The electrical plug connector according to claim 22 wherein the pins mounted to the second end of the support body protrude from the support body such as to penetrate into the socket end upon a full insertion of the support body into the casing part.

* * * * *